US007116930B2

(12) United States Patent
Wegman et al.

(10) Patent No.: US 7,116,930 B2
(45) Date of Patent: Oct. 3, 2006

(54) DISPENSER BOTTLE INCLUDING A CONDUIT PARTITION ASSEMBLY, AND AN IMAGE FORMING DEVICE INCLUDING THE SAME

(75) Inventors: Paul M. Wegman, Pittsford, NY (US); Mikhail Vaynshteyn, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 90 days.

(21) Appl. No.: 10/899,820

(22) Filed: Jul. 27, 2004

(65) Prior Publication Data

US 2006/0024091 A1 Feb. 2, 2006

(51) Int. Cl.
*G03G 15/08* (2006.01)

(52) U.S. Cl. ..... 399/262; 222/DIG. 1

(58) Field of Classification Search ..... 399/262, 399/120, 119; 220/653; 222/DIG. 1
See application file for complete search history.

(56) References Cited

U.S. PATENT DOCUMENTS 6,085,056 A * 7/2000 Okada ..... 399/262

6,249,655 B1 * 6/2001 Baek et al. ..... 222/DIG. 1

OTHER PUBLICATIONS

Machine translation of JP 2003140452 A (Yoshikawa et al.)*

* cited by examiner

*Primary Examiner*—David M. Gray
*Assistant Examiner*—Ruth N. LaBombard
(74) *Attorney, Agent, or Firm*—Wayne J. Egan

(57) ABSTRACT

Dispenser conduit partitions are used to improve the discharge flow of toner particles from a toner dispenser bottle in a host image forming device. A dispenser conduit partition assembly is inserted into the funnel-like dispenser conduit of the toner dispenser bottle. The conduit partition assembly is arranged with multiple partition members. The multiple partition members act to partition the single symmetric dispenser conduit into a corresponding multiplicity of asymmetric dispenser component conduits. As a result, the toner particles are dispensed by the multiple dispenser component conduits to thereby form a corresponding multiplicity of asymmetric toner particle discharge flows, thus reducing toner bridging.

20 Claims, 6 Drawing Sheets

DISPENSER BOTTLE INCLUDING A CONDUIT PARTITION ASSEMBLY, AND AN IMAGE FORMING DEVICE INCLUDING THE SAME

BACKGROUND OF THE INVENTION

Many toner containers are shaped like conventional bottles, where a cylindrical body containing a powder is joined with a smaller diameter bottle opening by a conically-shaped converging shaped like a funnel that helps to contain and direct the toner discharge flow. This classical bottle design works well with liquids. However, when the bottle-like cartridge is filled with a powder comprising, for example, toner particles, the substance exiting process is often hampered by well-known effects, known as "bridging" and "rat-holing" effects, which effects are inherent exit flow problems of all symmetrically-shaped funnel-like containers.

The foregoing bridging effect occurs when the toner powder forms internal spherical structure (arches), thus restricting or completely blocking the flow. When this happens in an image forming device such as an xerographic machine, the bottle must be removed from the image forming device (xerographic machine), then shaken well and reinserted into the image forming device. This process results in substantial annoyance or irritation in the machine users or customers.

Further, the foregoing rat-holing effect occurs when, due to the different friction forces between toner particles with other toner particles and toner particles and bottle walls, a hole is formed in the toner mass at the bottle exit. This hole is also shaped like a funnel in the dense, plug-like toner mass that remains in the bottle after all fluidized toner is discharged. Thus, the toner that forms the "rat-hole" remains in the bottle, unused and, as far as the customer is concerned, is wasted.

One known solution to these problems is to equip toner containers with internal agitators. However, this solution is costly compared to a simple blow molded toner bottle design.

BRIEF SUMMARY OF THE INVENTION

In a first aspect of the invention, there is described a dispenser bottle including a conduit partition assembly, the dispenser bottle having a dispenser bottle top end and an opposite dispenser bottle bottom end and comprising a tapered top dispenser portion and a cylindrical bottom container portion, the dispenser portion forming a dispenser mouth at the dispenser bottle top end, the container portion defining a container hollow, the dispenser portion having a dispenser portion inner wall that defines a dispenser conduit whose inner diameter becomes increasingly narrower along the dispenser portion from the container hollow towards the dispenser mouth; the dispenser conduit partition assembly having a shaft, the shaft having a shaft top end, an elongated shaft body defining a shaft axial and an opposite shaft bottom end, the shaft bottom end having a multiplicity (N) of substantially identical partition members attached thereto; the shaft bottom end with the attached multiple partition members disposed in the dispenser conduit; each partition member comprised of a sheet of flexible elastic material of a small thickness, the partition member forming two opposing generally flat and smooth outer surfaces, each outer surface defining a perimeter of four partition member edges, the four partition member edges including a generally straight partition member shaft-attaching edge and an opposite partition member outer edge, the partition member shaft-attaching edge fixed to the shaft body along the shaft axial near the shaft bottom end, the multiple partition members extending outwardly away from the shaft axial; the partition member outer edge of each partition member having a profile shape that is generally congruent with the shape of the dispenser portion inner wall so that urging the shaft towards the dispenser mouth causes the partition member outer edge of each partition member to substantially contact the dispenser portion inner wall, the multiplicity of partition members thus partitioning the dispenser conduit into a corresponding multiplicity (N) of dispenser component conduits.

In a second aspect of the invention, there is described an image forming device comprising a dispenser bottle arranged to dispense toner particles, the dispenser bottle including a conduit partition assembly, the dispenser bottle having a dispenser bottle top end and an opposite dispenser bottle bottom end and comprising a tapered top dispenser portion and a cylindrical bottom container portion, the dispenser portion forming a dispenser mouth at the dispenser bottle top end, the container portion defining a container hollow, the dispenser portion having a dispenser portion inner wall that defines a dispenser conduit whose inner diameter becomes increasingly narrower along the dispenser portion from the container hollow towards the dispenser mouth; the dispenser conduit partition assembly having a shaft, the shaft having a shaft top end, an elongated shaft body defining a shaft axial and an opposite shaft bottom end, the shaft bottom end having a multiplicity (N) of substantially identical partition members attached thereto; the shaft bottom end with the attached multiple partition members disposed in the dispenser conduit; each partition member comprised of a sheet of flexible elastic material of a small thickness, the partition member forming two opposing generally flat and smooth outer surfaces, each outer surface defining a perimeter of four partition member edges, the four partition member edges including a generally straight partition member shaft-attaching edge and an opposite partition member outer edge, the partition member shaft-attaching edge fixed to the shaft body along the shaft axial near the shaft bottom end, the multiple partition members extending outwardly away from the shaft axial; the partition member outer edge of each partition member having a profile shape that is generally congruent with the shape of the dispenser portion inner wall so that urging the shaft towards the dispenser mouth causes the partition member outer edge of each partition member to substantially contact the dispenser portion inner wall, the multiplicity of partition members thus partitioning the dispenser conduit into a corresponding multiplicity (N) of dispenser component conduits, so that the toner particles are dispensed by the multiple dispenser component conduits to thereby form a corresponding multiplicity of toner particle discharge flows.

BRIEF DESCRIPTION OF THE SEVERAL VIEWS OF THE DRAWING

FIG. 2 includes the reference line X.

Figure 2:
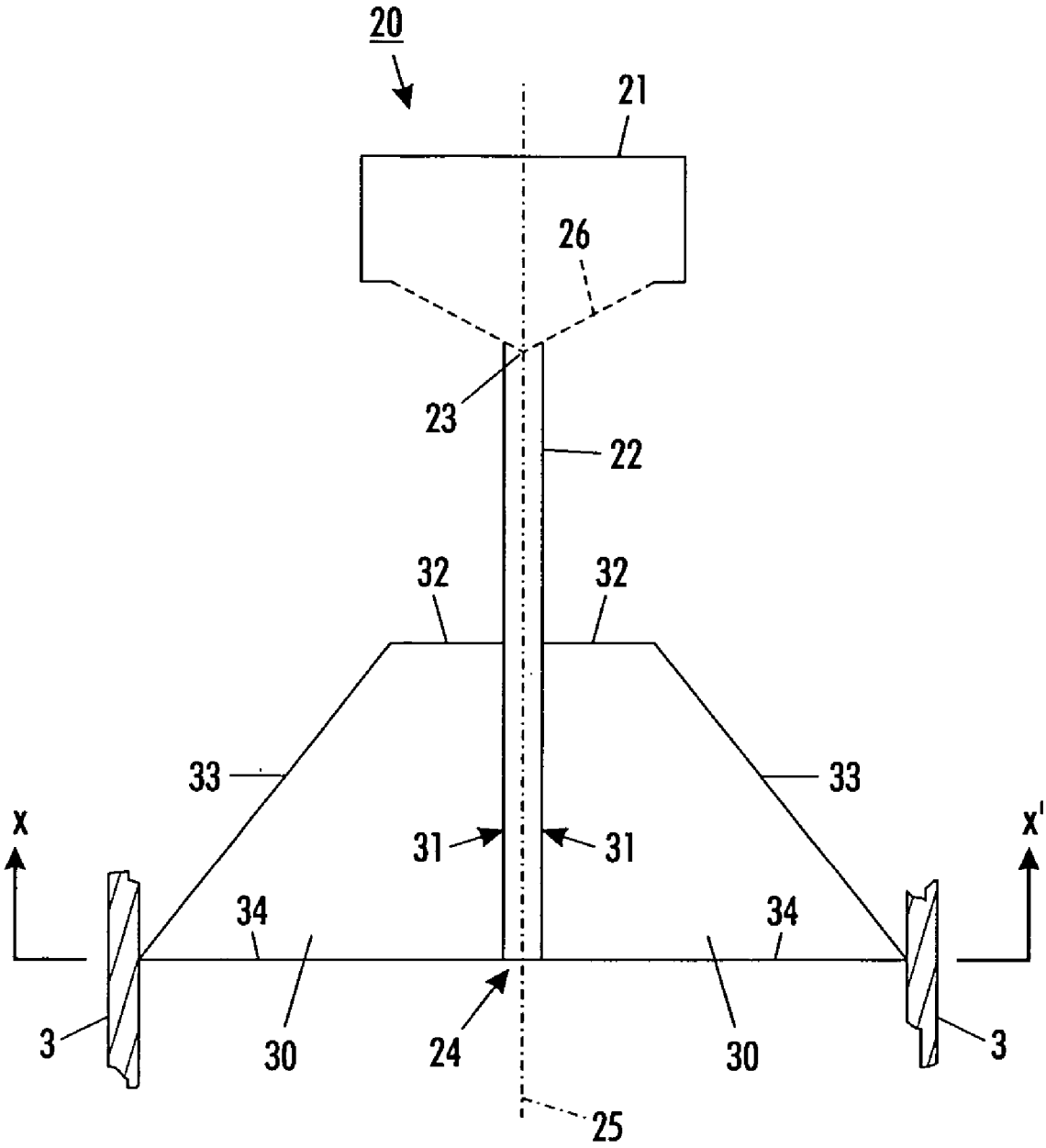
FIG. 2 is a cut-away profile view of the FIG. 1 conduit partition assembly 20. As shown, the conduit partition assembly 20 includes a multiplicity (N) of attached partition members 30.
Figure 4:
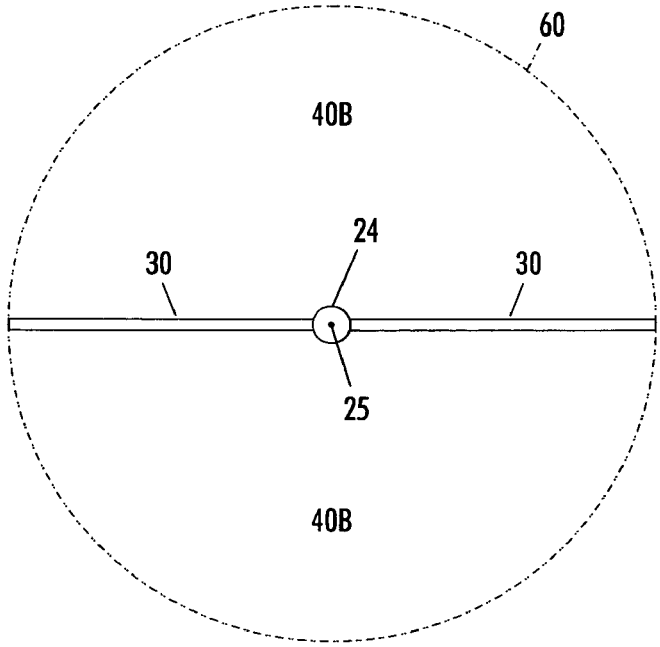

As described below, each drawing figure of FIGS. 4–7 is a bottom-up view of the FIG. 2 conduit partition assembly 20 along the reference line X, wherein:

FIG. 4 depicts the FIG. 2 conduit partition assembly 20 arranged with exactly two (2) partition members 30, thus N equals 2.

Figure 5:
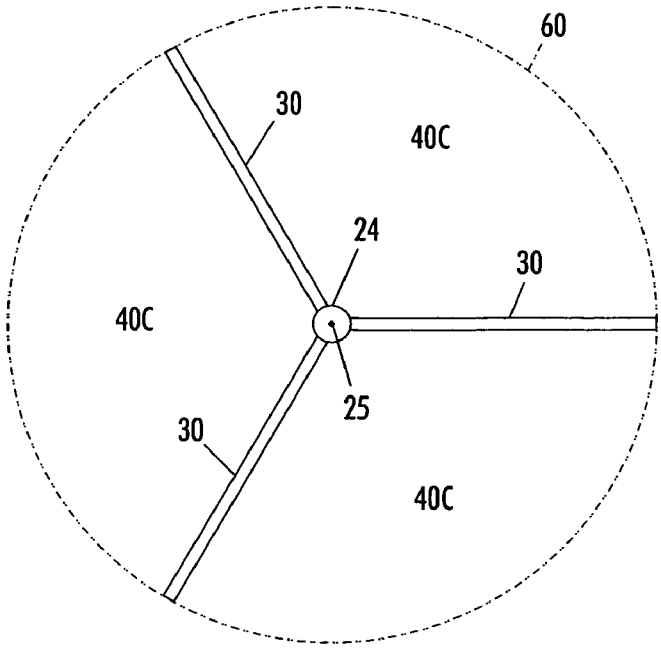

FIG. 5 depicts the FIG. 2 conduit partition assembly 20 arranged with exactly three (3) partition members 30, thus N equals 3.

Figure 6:
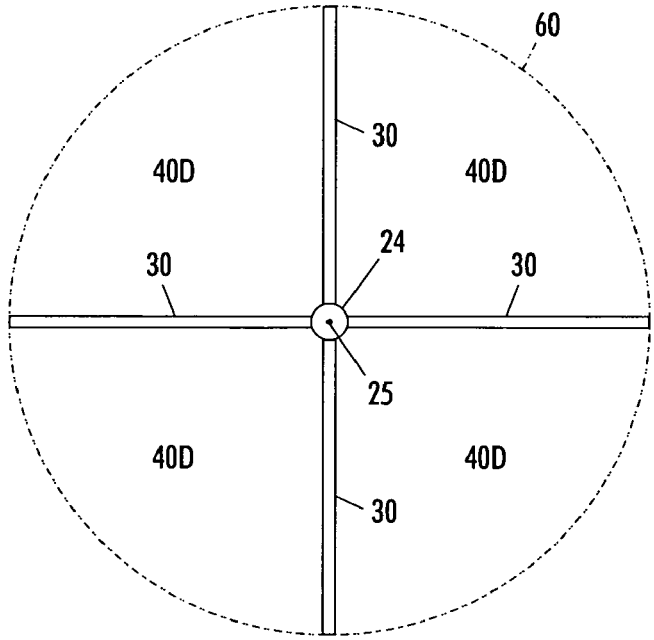

FIG. 6 depicts the FIG. 2 conduit partition assembly 20 arranged with exactly four (4) partition members 30, thus N equals 4.

Figure 7:
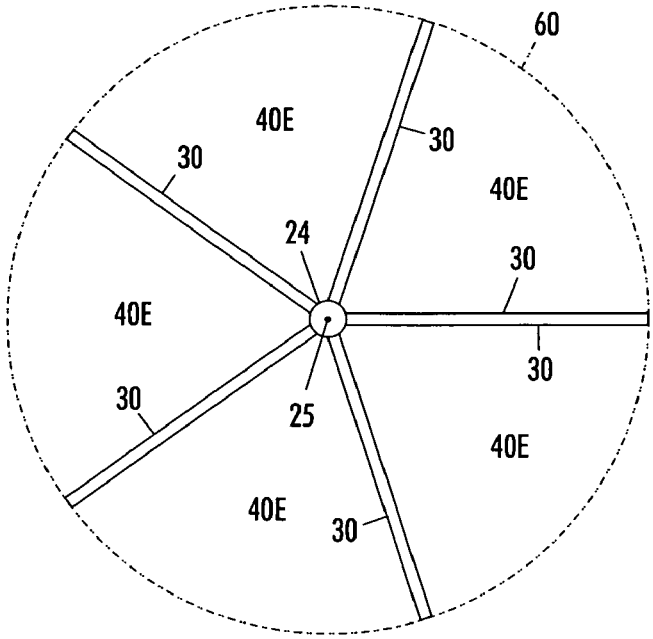

FIG. 7 depicts the FIG. 2 conduit partition assembly 20 arranged with exactly five (5) partition members 30, thus N equals 5.

Figure 1:
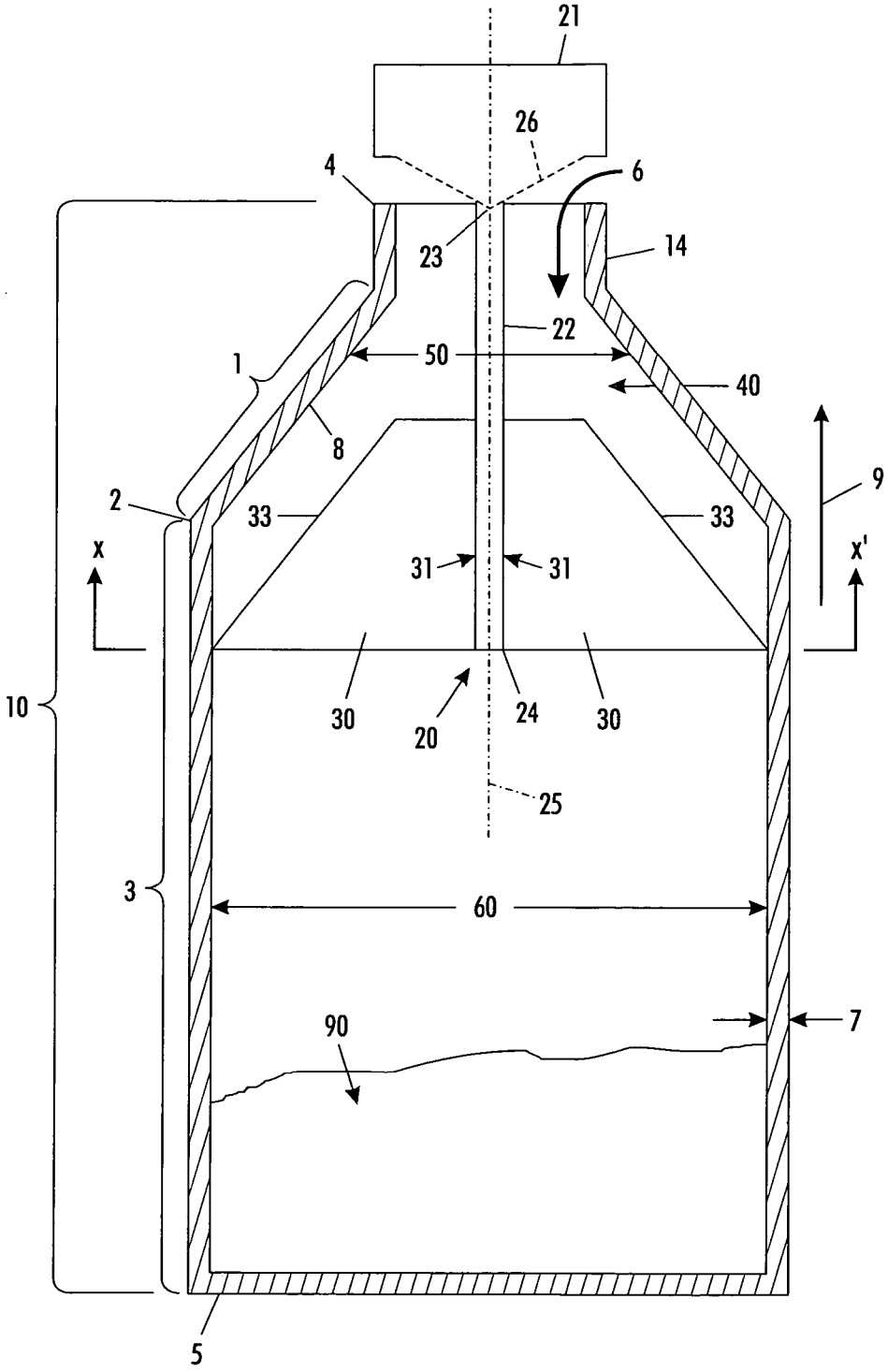
FIG. 1 is a cut-away profile view of a first embodiment of dispenser bottle 10 including a conduit partition assembly 20, in accordance with the present invention.
Figure 8:
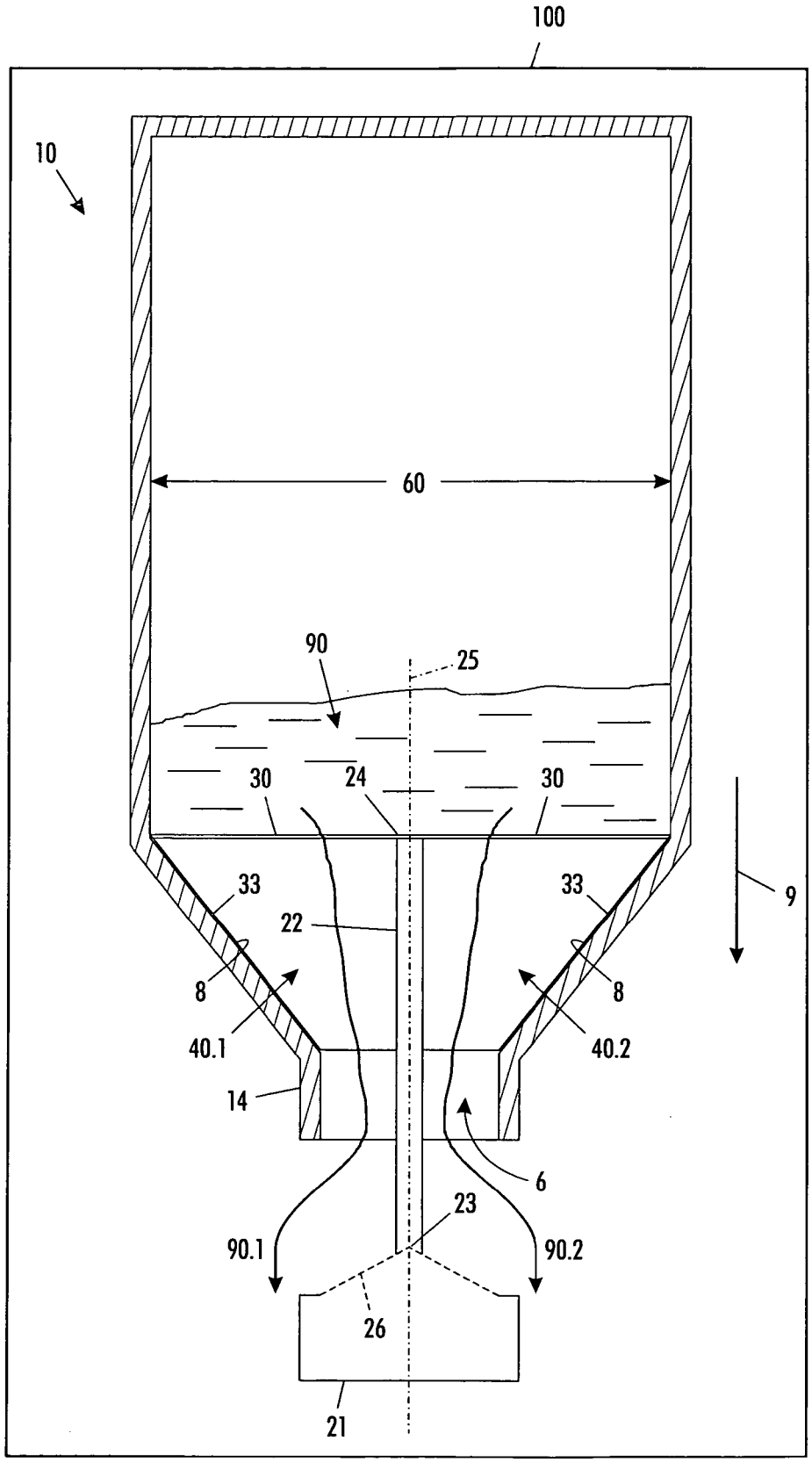

FIG. 8 depicts an image forming device 100 comprising the FIG. 1 dispenser bottle 10 including the conduit partition assembly 20.

DETAILED DESCRIPTION OF THE INVENTION

Briefly, dispenser conduit partitions are used to improve the discharge flow of toner particles from a toner dispenser bottle in a host image forming device. A dispenser conduit partition assembly is inserted into the funnel-like dispenser conduit of the toner dispenser bottle. The conduit partition assembly is arranged with multiple partition members. The multiple partition members act to partition the single symmetric dispenser conduit into a corresponding multiplicity of asymmetric dispenser component conduits. As a result, the toner particles are dispensed by the multiple dispenser component conduits to thereby form a corresponding multiplicity of asymmetric toner particle discharge flows, thus reducing toner bridging.

Referring now to FIG. 1, there is shown a dispenser bottle 10 including a conduit partition assembly 20. As shown, the dispenser bottle 10 defines a dispenser opening or mouth 6 and a container hollow 60, the container hollow 60 containing particles 90. In one embodiment, the particles 90 comprise toner. FIG. 1 includes a reference line X. A dispensing direction 9 is defined as the direction from the container hollow 60 towards the dispenser mouth 6. In FIG. 1 the dispensing direction 9 is depicted by the arrow 9. The dispenser bottle 10 has a dispenser bottle top end 4 and an opposite dispenser bottle bottom end. Also, the dispenser bottle 10 comprises a tapered top dispenser portion 1 and a cylindrical bottom container portion 3. The dispenser portion 1 forms a dispenser mouth 6 at the dispenser bottle top end 4. The container portion 3 defines a container hollow 60.

As shown, the dispenser portion 1 includes a dispenser portion inner wall 8 that defines a dispenser conduit 40 whose inner diameter 50 becomes increasingly narrower along the dispenser portion 1 from the container hollow 60 towards the dispenser mouth 6.

As shown in FIG. 1, the dispenser conduit partition assembly 20 includes a shaft 22. The shaft 22 has a shaft top end 23, an elongated shaft body 22 defining a shaft axial 25 and an opposite shaft bottom end 24. A multiplicity (N) of substantially identical partition members 30 are attached to the shaft body 22 generally near the shaft bottom end 24. The shaft bottom end 24 with the attached multiple partition members 30 is disposed in the dispenser conduit 40.

Figure 3:
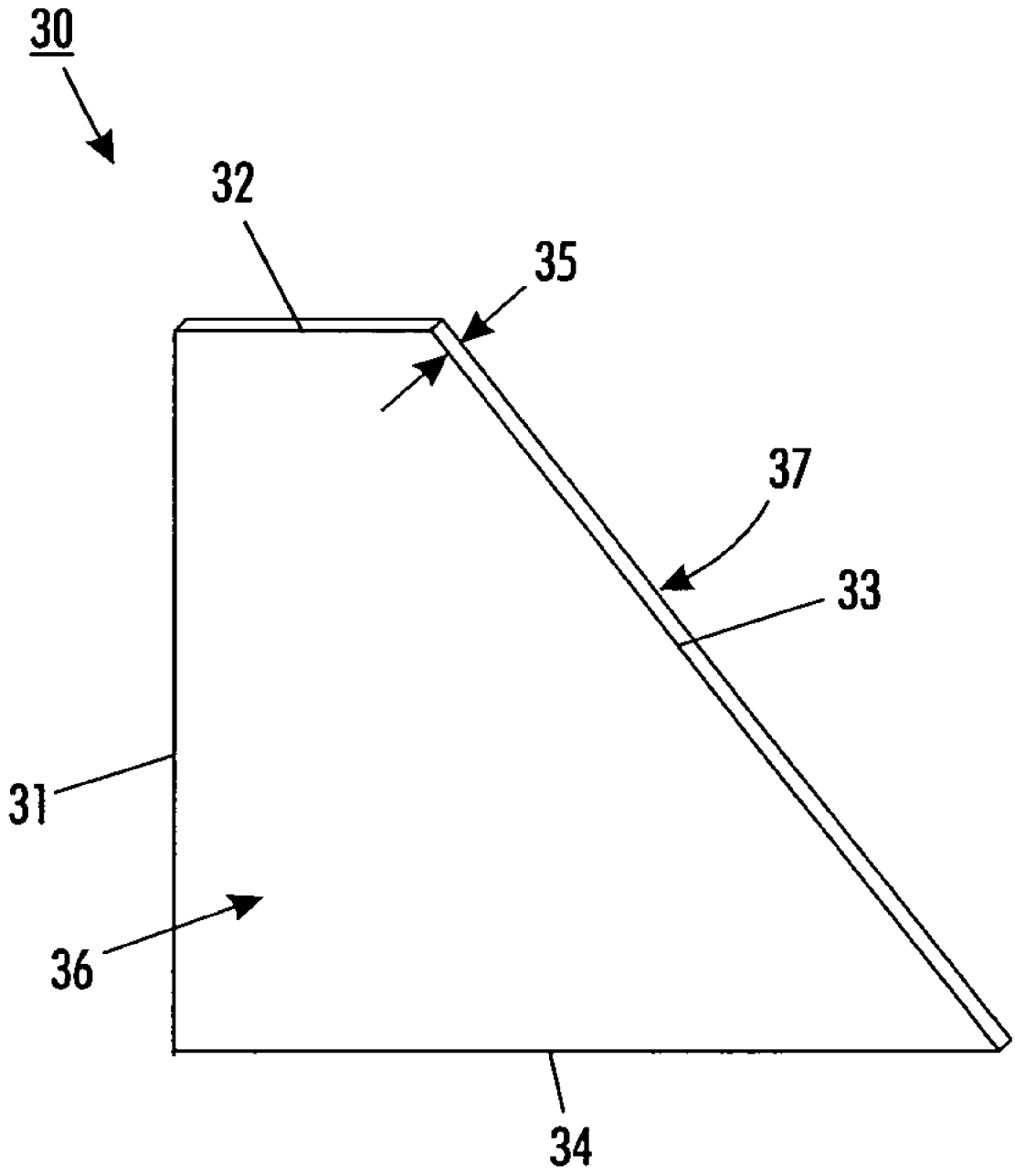
FIG. 3 is a perspective view of an individual FIG. 2 partition member 30.

Referring generally to FIGS. 1–3, each partition member 30 is comprised of a sheet of flexible elastic material of a small thickness 35, the thickness 35 being depicted in FIG. 3.

As shown in FIG. 3, the partition member 30 forms two (2) opposing generally flat and smooth outer surfaces 36, 37. Each outer surface 36, 37 defines a perimeter of four partition member edges 31, 32, 33, 34. The four partition member edges include a generally straight partition member shaft-attaching edge 31 and an opposite partition member outer edge 33.

As shown in FIGS. 2–3, the partition member shaft-attaching edge 31 is fixed to the shaft body 22, parallel to the shaft axial 25, near the shaft bottom end 24.

Referring generally to FIGS. 1–2 and 4–7, the multiple partition members 30 extend outwardly and radially away from the shaft axial 25.

Referring now to FIG. 8, as depicted therein, the dispenser bottle 10 is arranged to dispense toner particles 90 to the image forming device 100. As shown, the partition member outer edge 33 of each partition member has a profile shape that is generally congruent with the shape of the dispenser portion inner wall 8. As a result, urging the shaft 22 in the dispensing direction 9 towards the dispenser mouth 6 causes the outer edge 33 of each partition member 30 to substantially contact the dispenser portion inner wall 8, thus partitioning the dispenser conduit 40 into multiple dispenser component conduits 40.1 and 40.2. As shown in FIG. 8, the toner particles 90 are dispensed by the multiple dispenser component conduits 40.1 and 40.2 to thereby form corresponding multiple toner particle discharge flows 90.1 and 90.2. As shown, the partition member outer edge 33 of each partition member 30 has a profile shape that is generally congruent with the shape of the dispenser portion inner wall 8. As a result, urging the shaft 22 towards the dispenser mouth 6 causes the partition member outer edge 33 of each partition member 30 to substantially contact the dispenser portion inner wall 8. By such contact of the dispenser portion inner wall 8, the multiplicity of partition members 30 thereby partition the dispenser conduit 40 into a corresponding multiplicity (N) of dispenser component conduits 40B, 40C, 40D, 40E.

As described below, the foregoing multiple dispenser component conduits 40B, 40C, 40D and 40E are depicted in FIGS. 4–7, wherein each drawing figure is a bottom-up view of the FIG. 2 conduit partition assembly 20 along the reference line X.

In one embodiment, shown in FIG. 4, the dispenser conduit partition assembly 20 comprises a multiplicity (N) of two (2) partition members 30, thus N equals 2, thus partitioning the dispenser conduit 40 into two (2) dispenser component conduits 40B.

In another embodiment, shown in FIG. 5, the dispenser conduit partition assembly 20 comprises a multiplicity (N) of three (3) partition members 30, thus N equals 3, thus partitioning the dispenser conduit 40 into three (3) dispenser component conduits 40C.

In a further embodiment, shown in FIG. 6, the dispenser conduit partition assembly 20 comprises a multiplicity (N) of four (4) partition members 30, thus N equals 4, thus partitioning the dispenser conduit 40 into four (4) dispenser component conduits 40D.

In still another embodiment, shown in FIG. 7, the dispenser conduit partition assembly 20 comprises a multiplicity (N) of five (5) partition members 30, thus N equals 5, thus partitioning the dispenser conduit 40 into five (5) dispenser component conduits 40E.

It will be understood that, in still further embodiments, not shown in the drawing, the dispenser conduit partition assembly 20 comprises a multiplicity (N) of partition members 30 wherein N is greater than 5, thus N equals 6, 7, 8, 9, etc.

Referring to FIGS. 1–2 and 8, as depicted therein, in one embodiment, the dispenser conduit partition assembly 20 further comprises a plug 21 fixed to the shaft 22 at the shaft top end 23, the plug 21 forming a sealing surface 26 facing the dispenser mouth 6. The sealing surface 26 is shaped so that urging the sealing surface 26 towards the dispenser mouth 6 causes the dispenser mouth 6 to be sealed.

As shown in FIGS. 1 and 8, in one embodiment, the dispenser portion 1 is funnel-shaped or conical-shaped.

Still referring to FIGS. 1 and 8, in one embodiment, the dispenser mouth 6 comprises a cylindrical-shaped neck 14.

As shown in FIGS. 1 and 8, in one embodiment the container hollow 60 contains particles 90 such as, for example, toner particles.

Referring now to FIG. 8, there is shown an image forming device 100 comprising the FIG. 1 dispenser bottle 10 including the conduit partition assembly 20. The dispenser bottle 10 is arranged to dispense toner particles 90 to the image forming device 100. As shown, the dispenser bottle 10 includes the conduit partition assembly 20 that is described above in connection with FIGS. 1–7.

Still referring to FIG. 8, urging the shaft 22 towards the dispensing mouth 6 causes the multiplicity of partition members 30 to partition the dispenser conduit 40 into a corresponding multiplicity (N) of dispenser component conduits 40B, 40C, 40D, 40E. As depicted, the toner particles 90 are dispensed by the multiple dispenser component conduits 40B, 40C, 40D, 40E to thereby form a corresponding multiplicity of toner particle discharge flows. These multiple toner particle discharge flows include the toner particle discharge flows 90.1 and 90.2, as shown.

Still referring to FIG. 8, in one embodiment the image forming device 100 comprises a copy machine.

Still referring to FIG. 8, in one embodiment the image forming device 100 comprises a printer.

Still referring to FIG. 8, in one embodiment the image forming device 100 comprises a facsimile machine.

In summary, the present invention comprises inserting into a toner bottle 10 a partition (conduit partition assembly 20) that acts to change the symmetric, funnel-like, bottle exit area (dispenser conduit 40) into several (2, 3, 4 or 5) asymmetric funnels (dispenser component conduits 40B, 40C, 40D, 40E) and thus prevent toner bridging.

In one embodiment, the conduit partition assembly 20 is attached to the toner bottle 10's screw-in plug 21 by a shaft 22 and is made from a flexible and elastic plastic material. This plastic partition 20 is wrapped around the shaft 22 to allow its insertion into the toner bottle's dispenser conduit 40 and then, when inserted, due to elasticity, the plastic partition 20 assumes its original rocket fin-like shape, as depicted in FIGS. 4–7.

In one embodiment, the plug 21 includes a sealing surface 26 facing the attached shaft 22 and conduit partition assembly 20, the sealing surface 26 being conically-shaped to ease the toner discharge when the plug 21 is unscrewed, as depicted in FIG. 8.

Thus, the resulting asymmetric dispenser component conduits 40B, 40C, 40D, 40E act to substantially reduce any bridging and rat-holing since there are no opposing parallel areas in the new conduits 40B, 40C, 40D and 40E.

A further advantage of a toner dispenser bottle 10 including a conduit partition assembly 20 is that, as the conduit partition 20 is attached to the screw-in plug 21, when the plug 21 is unscrewed, the attached conduit partition assembly 20 thereby acts like an agitator to further ease the discharge of the toner.

The conduit partition assembly 20 is relatively easy and inexpensive to manufacture.

A further advantage of a toner dispenser bottle 10 including a conduit partition assembly 20 is increased productivity of the host image forming device 100 and corresponding increased customer satisfaction.

A further advantage of the toner dispenser bottle 10 including a conduit partition assembly 20 is that it substantially reduces the need for the customer to shake the toner bottle 10. This reduction is particularly advantageous in view of the fact that toner particles will more easily empty from a bottle that has not been shaken. Also, in toner bottles without the benefit of the present invention, proper shaking is still required to appropriately agitate the toner so it can empty from the bottle. This customer shaking, however, is problematic, and is a compliance and ergonomic issue.

The table below lists the drawing FIGS. 1–8 element reference numbers together with their corresponding written description:

| Reference number | Description |
|---|---|
| 1 | dispenser portion |
| 2 | juncture of dispenser and container portions |
| 3 | container portion |
| 4 | bottle top |
| 5 | bottle bottom |
| 6 | dispenser mouth |
| 7 | dispenser container wall thickness |
| 8 | dispenser portion inner wall |
| 9 | dispensing direction |
| 10 | dispenser bottle |
| 14 | dispenser bottle neck |
| 20 | conduit partition assembly |
| 21 | plug |
| 22 | shaft body |
| 23 | shaft top end |
| 24 | shaft bottom end |
| 25 | shaft axial |
| 26 | sealing surface |
| 30 | partition member |
| 31 | partition member shaft-attaching edge |
| 32 | partition member top edge |
| 33 | partition member outer edge |
| 34 | partition member bottom edge |
| 35 | partition member thickness |
| 36 | partition member outer surface |
| 37 | partition member outer surface |
| 40 | dispenser conduit |
| 40B, 40C, 40D, 40E | dispenser component conduits |
| 50 | dispenser conduit inner diameter |
| 60 | container hollow |
| 90 | particles |
| 90.1, 90.2 | toner particle discharge flows |
| 100 | image forming device |

While various embodiments of a dispenser bottle including a conduit partition assembly, and an image forming device including the same, in accordance with the present invention, have been described hereinabove, the scope of the invention is defined by the following claims.

What is claimed is:

1. A dispenser bottle arranged to dispense particles including a conduit partition assembly, the dispenser bottle having a dispenser bottle top end and an opposite dispenser bottle bottom end and comprising a tapered top dispenser portion and a cylindrical bottom container portion, the dispenser portion forming a dispenser mouth at the dispenser bottle top end, the container portion defining a container hollow, the dispenser portion having a tapered top dispenser portion inner wall that defines a dispenser conduit whose inner diameter becomes increasingly narrower along the dispenser portion from the container hollow towards the dispenser mouth;

the dispenser conduit partition assembly having a shaft, the shaft having a shaft top end protruding from the dispenser mouth, an elongated shaft body defining a shaft axial and an opposite shaft bottom end, the shaft bottom end having a multiplicity (N) of substantially identical partition members attached thereto; the shaft bottom end with the attached multiple partition members disposed in the dispenser conduit;

each partition member comprised of a sheet of flexible elastic material of a small thickness, the partition member forming two opposing generally flat and smooth outer surfaces, each outer surface defining a perimeter of four partition member edges, the four partition member edges including a generally straight partition member shaft-attaching edge and an opposite partition member outer edge, the partition member shaft-attaching edge fixed to the shaft body along the shaft axial near the shaft bottom end, the multiple partition members extending outwardly away from the shaft axial;

the partition member outer edge of each partition member having a tapered profile shape that is generally congruent with the tapered shape of the tapered top dispenser portion inner wall so that urging the conduit partition assembly shaft body towards the dispenser mouth causes the partition member tapered-profile shaped outer edge of each partition member to move closer to and substantially contact the tapered top dispenser portion inner wall, the multiplicity (N) of partition members partitioning the dispenser conduit to thereby form a corresponding multiplicity (N) of dispenser component conduits, so that when the dispenser bottle cylindrical bottom container portion is inverted in a generally vertical position, a corresponding multiplicity (N) of particle discharge flows are dispensed from the dispenser mouth, wherein the dispenser bottle and the included conduit partition assembly are constructed and arranged so that the conduit partition assembly shaft body is movable towards the dispenser mouth.

2. The dispenser bottle including a conduit partition assembly of claim 1, the dispenser conduit partition assembly comprising exactly three (3) partition members, thus N equals 3.

3. The dispenser bottle including a conduit partition assembly of claim 1, the dispenser conduit partition assembly comprising exactly four (4) partition members, thus N equals 4.

4. The dispenser bottle including a conduit partition assembly of claim 1, the dispenser conduit partition assembly comprising exactly five (5) partition members, thus N equals 5.

5. The dispenser bottle including a conduit partition assembly of claim 1, the dispenser conduit partition assembly further comprising a plug fixed to the shaft at the shaft top end, the plug forming a sealing surface facing the dispenser mouth, the sealing surface shaped so that urging the sealing surface towards the dispenser mouth causes the dispenser mouth to be sealed.

6. The dispenser bottle including a conduit partition assembly of claim 5, the dispenser conduit partition assembly comprising exactly two (2) partition members, thus N equals 2.

7. The dispenser bottle including a conduit partition assembly of claim 5, the dispenser portion being conical-shaped.

8. The dispenser bottle including a conduit partition assembly of claim 7, the dispenser mouth comprising a cylindrical-shaped neck.

9. The dispenser bottle including a conduit partition assembly of claim 8, the container hollow containing particles.

10. The dispenser bottle including a conduit partition assembly of claim 9, the particles comprising toner.

11. An image forming device comprising a dispenser bottle arranged to dispense toner particles, the dispenser bottle including a conduit partition assembly, the dispenser bottle having a dispenser bottle top end and an opposite dispenser bottle bottom end and comprising a tapered top dispenser portion and a cylindrical bottom container portion, the dispenser portion forming a dispenser mouth at the dispenser bottle top end, the container portion defining a container hollow, the dispenser portion having a tapered top dispenser portion inner wall that defines a dispenser conduit whose inner diameter becomes increasingly narrower along the dispenser portion from the container hollow towards the dispenser mouth;

the dispenser conduit partition assembly having a shaft, the shaft having a shaft top end protruding from the dispenser mouth, an elongated shaft body defining a shaft axial and an opposite shaft bottom end, the shaft bottom end having a multiplicity (N) of substantially identical partition members attached thereto; the shaft bottom end with the attached multiple partition members disposed in the dispenser conduit;

each partition member comprised of a sheet of flexible elastic material of a small thickness, the partition member forming two opposing generally flat and smooth outer surfaces, each outer surface defining a perimeter of four partition member edges, the four partition member edges including a generally straight partition member shaft-attaching edge and an opposite partition member outer edge, the partition member shaft-attaching edge fixed to the shaft body along the shaft axial near the shaft bottom end, the multiple partition members extending outwardly away from the shaft axial;

the partition member outer edge of each partition member having a tapered profile shape that is generally congruent with the tapered shape of the tapered top dispenser portion inner wall so that urging the conduit partition assembly shaft body towards the dispenser mouth causes the partition member tapered-profile shaped outer edge of each partition member to move closer to and substantially contact the tapered top dispenser portion inner wall, the multiplicity (N) of partition members partitioning the dispenser conduit to thereby form a corresponding multiplicity (N) of dispenser component conduits, so that when the dispenser bottle cylindrical bottom container portion is inverted in a generally vertical position, a corresponding multiplicity (N) of toner particle discharge flows are dispensed from the dispenser mouth, wherein the dispenser bottle and the included conduit partition assembly are constructed and arranged so that the conduit partition assembly shaft body is movable towards the dispenser mouth.

12. The image forming device of claim 11, the dispenser conduit partition assembly comprising exactly three (3) partition members, thus N equals 3.

13. The image forming device of claim 11, the dispenser conduit partition assembly comprising exactly four (4) partition members, thus N equals 4.

14. The image forming device of claim 11, the dispenser conduit partition assembly comprising exactly five (5) partition members, thus N equals 5.

15. The image forming device of claim 11, in the dispenser bottle, the included dispenser conduit partition assembly further comprising a plug fixed to the shaft at the shaft top end, the plug forming a sealing surface facing the dispenser mouth, the sealing surface shaped so that urging the sealing surface towards the dispenser mouth causes the dispenser mouth to be sealed.

16. The image forming device of claim 15, the dispenser conduit partition assembly comprising exactly two (2) partition members, thus N equals 2.

17. The image forming device of claim 15, in the dispenser bottle, the dispenser portion being conical-shaped and the dispenser mouth comprising a cylindrical-shaped neck.

18. The image forming device of claim 15 comprising a copy machine.

19. The image forming device of claim 15 comprising a printer.

20. The image forming device of claim 15 comprising a facsimile machine.

* * * * *